US010577821B2

(12) United States Patent
Moreno et al.

(10) Patent No.: US 10,577,821 B2
(45) Date of Patent: Mar. 3, 2020

(54) ILLUMINATED NICHES FOR STRONG CINERARY URNS

(71) Applicant: GRUPO GAYOSSO S.A. DE C.V., Mexico City (MX)

(72) Inventors: Guillermo Alejandro Moreno, Mexico City (MX); Abigail Alejandro Sosa Hernandez, State of Mexico (MX)

(73) Assignee: GRUPO GAYOSSO S.A. DE C.V., Mexico City (MX)

( * ) Notice: Subject to any disclaimer, the term of this patent is extended or adjusted under 35 U.S.C. 154(b) by 0 days.

(21) Appl. No.: 16/120,646

(22) Filed: Sep. 4, 2018

(65) Prior Publication Data

US 2019/0100936 A1 Apr. 4, 2019

(30) Foreign Application Priority Data

Sep. 4, 2017 (MX) ..... A/2017/011282

(51) Int. Cl.

| | |
|---|---|
| ***E04H 13/00*** | (2006.01) |
| ***A47F 11/10*** | (2006.01) |
| ***A47F 3/00*** | (2006.01) |
| ***A47F 7/28*** | (2006.01) |
| *E04B 1/19* | (2006.01) |
| *E04B 1/348* | (2006.01) |

(Continued)

(52) U.S. Cl.

CPC ..... *E04H 13/008* (2013.01); *A47F 3/001* (2013.01); *A47F 3/005* (2013.01); *A47F 7/283* (2013.01); *A47F 11/10* (2013.01); *A47B 2220/0077* (2013.01); *E04B 1/19* (2013.01); *E04B 1/24* (2013.01); *E04B 1/34807* (2013.01); *E04B 2001/2481* (2013.01); *E04H 1/005* (2013.01); *E04H 13/006* (2013.01)

(58) Field of Classification Search

CPC ..... E04H 13/008; E04H 13/006; E04H 13/00; A61G 17/08; E05B 65/0057

See application file for complete search history.

(56) References Cited

U.S. PATENT DOCUMENTS 1,775,471 A * 9/1930 Mershon ..... E04H 13/006 52/132
1,946,977 A * 2/1934 Lenke ..... E04B 5/46 404/22

(Continued)

FOREIGN PATENT DOCUMENTS

KR 2011007582 U * 8/2011
MX 221141 6/2004

*Primary Examiner* — Jessie T Fonseca

(74) *Attorney, Agent, or Firm* — Alston & Bird LLP

(57) ABSTRACT

The present invention relates to an illuminated niche for storing cinerary urns. The niche includes a bottom wall, a top wall, a right side wall, and a left side wall that together define a hollow rectangular body. The niche includes a rear wall made of a translucent material configured to seal the niche at a rear end and allow a light flux to enter the interior of the niche. The niche includes a perimeter frame provided at an opposing end of the rectangular body. The perimeter frame defines an access area and provides a support frame for a fastening system. The fastening system receives an access door that allows access to the interior of the niche. The access door is made of a transparent material to allow the access door to act as a screen through which it is possible to see the illuminated interior of the niche.

14 Claims, 14 Drawing Sheets

(51) Int. Cl.
*E04H 1/00* (2006.01)
*E04B 1/24* (2006.01)

(56) References Cited

U.S. PATENT DOCUMENTS 2,513,951 A * 7/1950 McClellen ..... E04H 13/006 27/1
3,076,292 A * 2/1963 Arbogast ..... E04H 13/006 264/277
3,254,773 A * 6/1966 Diem ..... E04H 13/006 211/188
3,417,521 A * 12/1968 Welsh ..... E04H 13/006 52/134
3,529,730 A * 9/1970 Thompson ..... E04H 13/006 211/1
3,754,805 A * 8/1973 Pangburn ..... E04H 13/006 211/84
3,925,944 A * 12/1975 Pickel ..... E04H 13/006 52/133
4,519,173 A * 5/1985 Roberts ..... E04H 13/006 52/235
5,134,758 A * 8/1992 Christensen ..... B28B 19/0046 27/35
5,195,812 A * 3/1993 Eickhof ..... A47B 47/0091 312/257.1
5,477,594 A * 12/1995 Lepage ..... E04H 13/006 211/194
5,625,933 A * 5/1997 Neuberger ..... A61G 17/08 27/1
5,881,505 A * 3/1999 Larkin, III ..... E04H 13/006 211/85.27
5,979,124 A * 11/1999 Branan ..... E04H 13/006 52/134
6,347,439 B1 * 2/2002 Bach Lahor ..... E04H 13/006 27/1
7,318,262 B1 * 1/2008 Florea ..... A61G 17/04 27/1
7,926,228 B1 * 4/2011 Snow ..... E04H 13/008 27/35
9,080,344 B2 7/2015 Young et al.
2006/0179622 A1 * 8/2006 Min ..... E04H 13/006 27/1
2008/0078074 A1 * 4/2008 McCampbell ..... E04H 13/006 27/1
2009/0199376 A1 * 8/2009 Hume ..... E04H 13/006 27/1
2009/0282752 A1 * 11/2009 Stilnovich ..... E04H 13/006 52/133
2010/0165639 A1 * 7/2010 Skeele ..... E04H 13/006 362/326
2011/0126480 A1 * 6/2011 Tsao ..... E04H 13/006 52/133
2011/0154748 A1 * 6/2011 Young ..... E04H 13/006 52/136
2011/0289864 A1 * 12/2011 King ..... E04F 13/0812 52/173.1
2012/0167488 A1 * 7/2012 Eickhof ..... E04H 13/006 52/139
2013/0199111 A1 * 8/2013 Eickhof ..... E04H 13/006 52/134
2017/0183889 A1 * 6/2017 Rossi ..... E04H 13/008
2017/0328082 A1 * 11/2017 Bailey ..... A61G 17/0136
2018/0223558 A1 * 8/2018 Birkmeier ..... E04H 13/008

* cited by examiner

ILLUMINATED NICHES FOR STRONG CINERARY URNS

CROSS-REFERENCE TO RELATED APPLICATIONS

This application claims priority to Mexican Patent Application No. MX/a/2017/011282 filed Sep. 4, 2017, the contents of which are hereby incorporated by reference in its entirety.

TECHNICAL FIELD OF THE INVENTION

The present invention is within the field of columbariums comprising a plurality of niches for storing cinerary urns and more specifically, refers to niches that integrate an individual closure system that allows the fixing and removal of an access door to the interior of the niche, where said door also fulfills the function of being a screen through which it is possible to see the illuminated interior of each niche.

BACKGROUND OF THE INVENTION

Since its inception, the human being has had to face death and along with it the need to allocate a specific site to deposit the bodily remains of their beloved ones, using small areas of land specifically designed for that purpose known as cemeteries, however, with the fast growth of the population, said spaces quickly diminished in their capacity to house bodies, so as this need grew, other options were sought to deposit human remains and one of these solutions was the columbarium, that is, a set of niches arranged in the cemeteries where cinerary urns were placed, the columbarium currently being one of the most widely used options for the deposit of arid remains.

After the implementation of the columbariums, the problem no longer referred to the physical space where the human remains were deposited, but to the characteristics of the niches from which these columbariums were built, which were initially erected with stone and mud or with bricks and cement, representing fixed and permanent constructions that included wide extensions of land in spaces originally destined for this purpose.

Although over time the columbariums improved their appearance by implementing materials such as marble, they maintained the restriction of not adapting to the spaces originally conceived for their installation, as well as being unpleasant to the eye.

Recently, contributions have been made in the field of niches for the deposition of human ash, however, by solving the problem of physical problems, these contributions have generated new problems, which are generally reflected in the external appearance of the niches, its, functionality, lack of security relating to the protection of its contents and the dark and cold that they are as a result both of its interior and exterior.

Likewise, it must be said that the current closure systems implemented in the niches known to date, are impractical, since sometimes closure elements are implemented sharing up to four niches, that is, an individualized closure system is not common for each niche and when it exists, it is not very aesthetic or low security, allowing any person equipped with just a screwdriver or tweezers access the interior of a niche and along with it to the values that are protected in it.

It is widely known that the cover of the niches currently implemented is a marble plate, which requires special care to be removed, because due to the hardness characteristics of this material, it is exposed to suffer cracks or ruptures that make it impossible to continue to be used, in addition that through this material is completely impossible to have visual access to the interior of the niche, a condition that requires the constant removal and placement of the cover to thereby be able to visualize the interior of the niche, action that potentiates the risk of damaging the cover and with it the integration of a niche.

The solution to the problem of physical space, the individuality of the niches and the access to the interior of them is reflected in the patent documents listed below:

U.S. Pat. No. 9,080,344 dated Jul. 14, 2015, issued to Charles T Young and Kennth B. Bridgeman for the invention entitled "Modular Crypt and Modular Crypt System with Niche Side Wall", in which a modular crypt structure is disclosed and protected comprises a frame, a module insert defining a chamber and a closure panel and methods for construction thereof. The chamber works as a crypt module and is adapted to receive bodily remains or portions thereof. The chamber is closed by joining a closure panel, such as the front part of a stone crypt to the frame, by which encapsulates the body remains. The modular crypt structure may comprise a plurality of chambers whereby a plurality of crypt modules is provided and the frame may comprise a plurality of horizontal bars and a plurality of vertical bars. A method for constructing a modular crypt structure comprising constructing a frame, providing at least one module insert, configuring the insert to define a chamber adapted to receive the bodily remains and closing the crypt module is described. A modular crypt system is disclosed which includes a niche side wall, having a niche side wall frame, a niche insert defining a plurality of niches placed within the frame and a closure panel placed in the side wall frame of the niche.

U.S. Pat. No. 5,477,594 issued Dec. 26, 1995 to Bernard E. LePage for the invention titled "Niche Panel" from which a modular urn holder comprising a niche panel made of a material of polymer, wherein each niche panel is convertible and a top wall, a bottom wall and a side wall of the urn holder can be used, the niche panels being interconnected by corner connectors that are slidably connected to the ends of the panels, likewise the niche panel comprises two panel members that are snap-assembled to form the hollow panel and each panel is molded to contain slits that provide the shelves a slidable coupling within the slots to subdivide the niche into smaller compartments, finally the niche is adaptable to accept a variety of types of front shutters.

In U.S. Pat. No. 5,195,812 dated Mar. 3, 1993, granted to John K. Eickhof for the invention titled "Columbarium", a columbarium is disclosed which is constructed with a frame having vertically extending spacers and presenting support elements, wherein link bars extend horizontally through the supports to connect the vertical dividers and the shelves rest on the support elements in the spaces formed by separators that extend vertically and also conceal the link bars, giving an improved appearance, the backrest covers the back of the columbarium and the front covers conceal each niche, decorative stone linings can then be attached to the front of the shelves, achieving a variety of sizes due to the flexibility and height of the vertical dividers and the width of the link bars. Additionally the columbarium can be constructed using modules that can be transported and then assembled with additional link bars that extend between the supports.

And finally the patent MX 221141 granted on Jun. 23, 2004 to Martin Gómez Bisogno titled "Method to elaborate crypts, for deposits of ashes and arid remains and methods of installing the same", novel crypts for deposits of ashes and arid remains are disclosed and claimed that are built through frames that are embedded or are assembled under pressure, consisting of a steel structure that functions as a support for the modular or furniture, specifically works as a skeleton joined by autogenous welding that join the parts, automotive paint and sealant used to prevent corrosion and wear, galvanized sheet that separates both horizontal and vertical divisions forming independent drawers, marble to cover the remaining drawer and escutcheons and screws to secure said marble top.

From the teachings of the prior art presented before and other teaching that without being disclosed are part of the field of application of the proposed invention, it is possible to say that the majority of the current proposals of niches, although they allow the integration of columbariums from a plurality of niches, none of them anticipates to the possibility of each niche incorporate as part of its structural configuration a system of individual closure that allows the fixing and removal of an access door to the interior of the niche, wherein said door also fulfills the function of being a screen through which it is possible to see the illuminated interior of each niche, which is why under the title "Illuminated niches for storing cinerary urns", this novel invention is disclosed with the following objects.

BRIEF SUMMARY

An object of the present invention is to provide illuminated niches for storing cinerary urns.

Another object of the present invention is to provide illuminated niches for storing cinerary urns, where each niche comprises an individual closure system that allows the fixing and removal of an access door to the interior of the niche.

Another object of the present invention is to provide illuminated niches for storing cinerary urns, where the door of each niche fulfills the function of being a screen through which it is possible to see the interior thereof.

Another object of the present invention is to provide illuminated niches for storing cinerary urns, wherein each niche comprises a translucent rear wall that allows the passage of a light flux into the interior of the niche.

Another object of the present invention is to provide illuminated niches for storing cinerary urns, where the light flux that illuminates the interior of each niche is generated from warm LED lighting.

Another object of the present invention is to provide illuminated niches for storing cinerary urns, wherein each niche has a rectangular configuration with two side walls, a top wall, a bottom wall, a rear wall and a front wall or access door.

Another objective of the present invention is to provide illuminated niches for storing cinerary urns, where the lateral, top and bottom walls of each niche can form part of the same modular structure.

Still another object of the present invention is to provide illuminated niches for storing cinerary urns, where, from a plurality of niches it is possible to achieve the integration of a columbarium that adapts in number of niches and dimensions to various spaces designed for its installation.

The objects of the present invention referred to above and even others not mentioned, as well as the characteristic aspects and advantages of the proposed invention will be apparent from the description of the invention and the accompanying figures that illustrate and not limit the invention.

DETAILED DESCRIPTION

Figure 1:
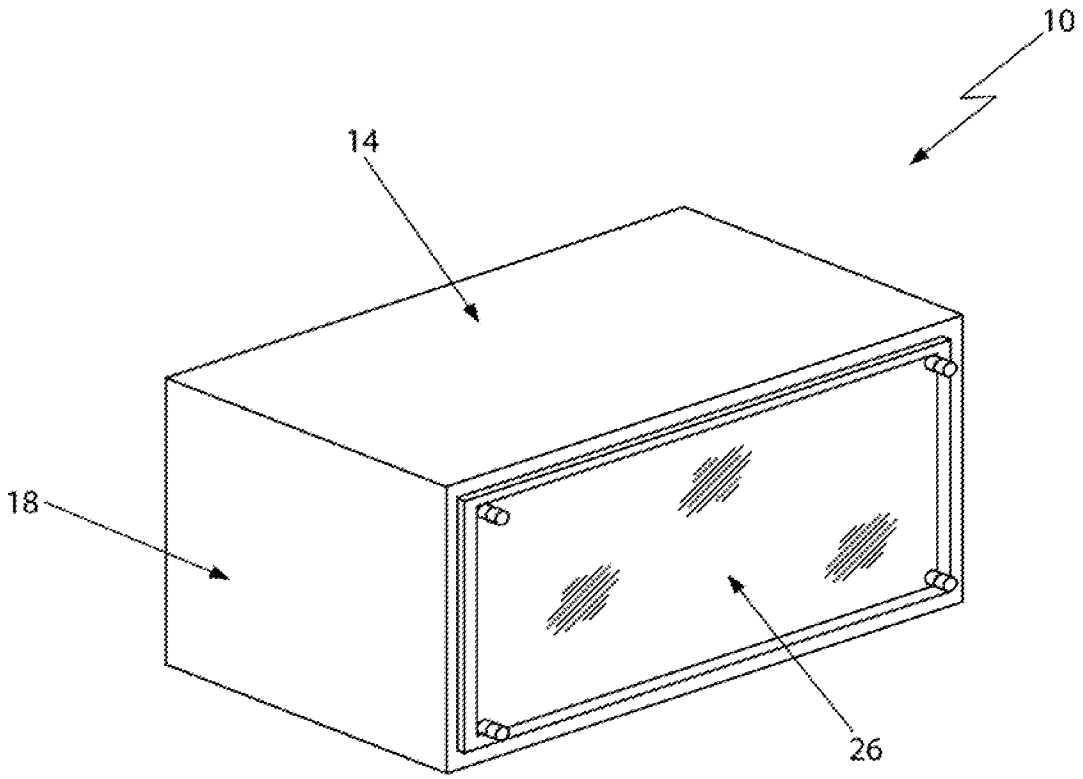
FIG. 1 shows a conventional perspective view of an illuminated niche for storing cinerary urns, made in accordance with the present invention.
Figure 2:
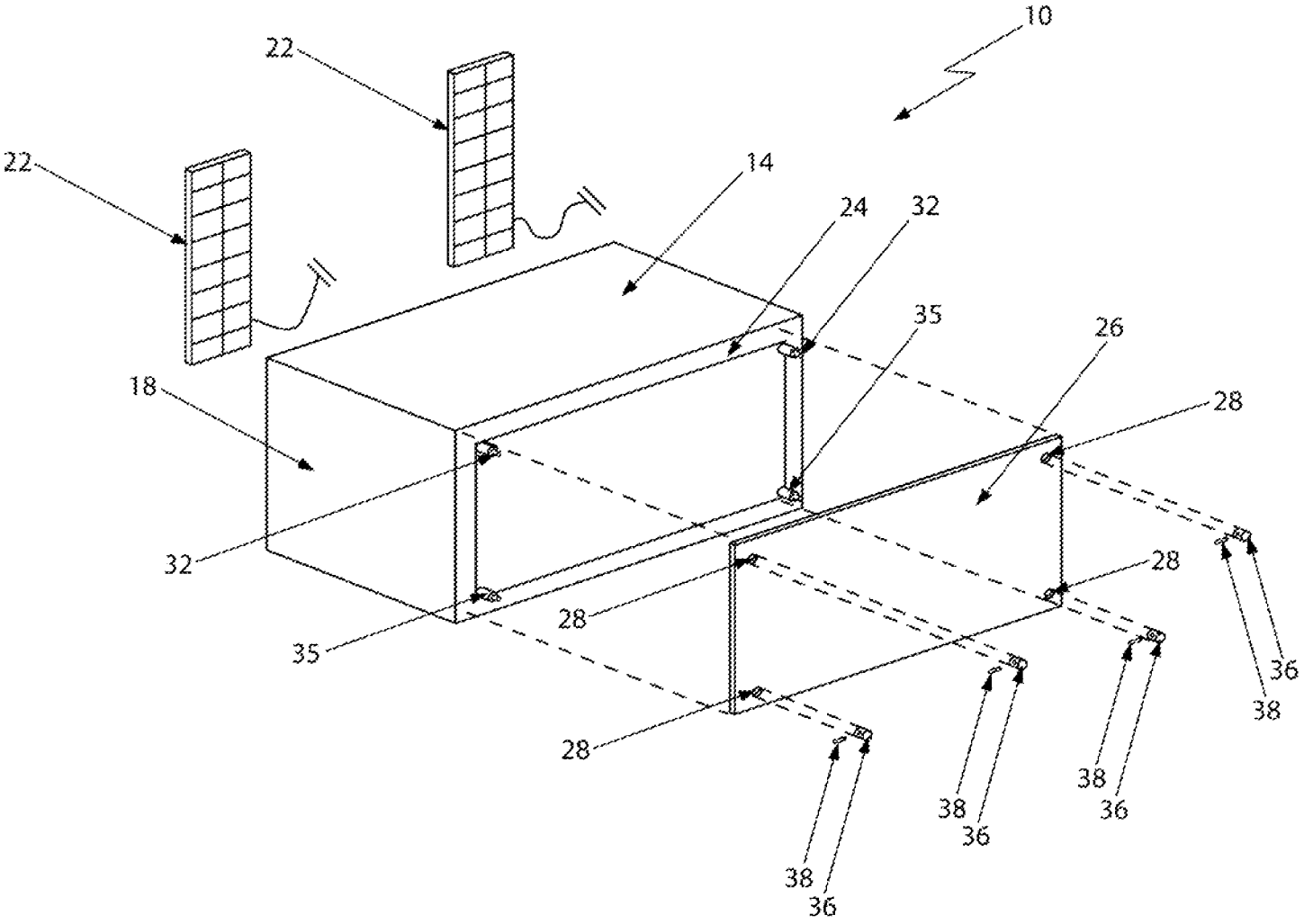
FIG. 2 shows an exploded view of niche of FIG. 1.
Figure 3:
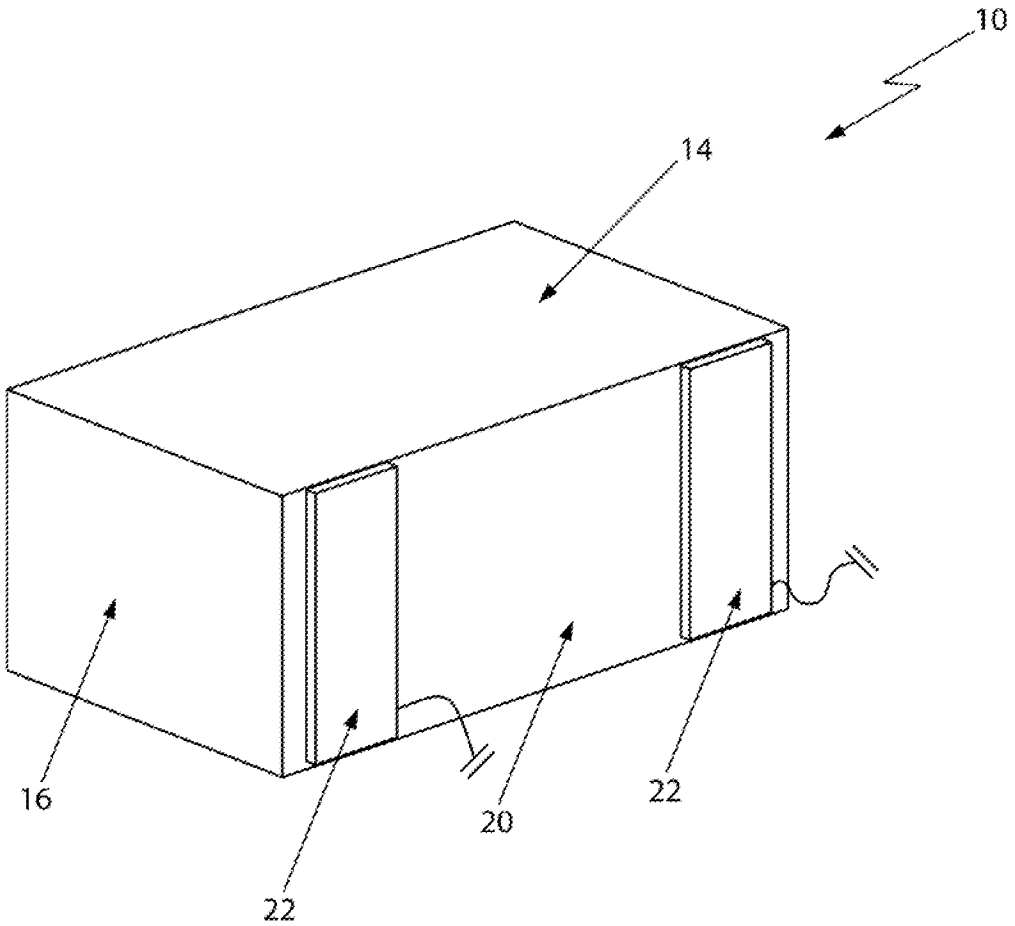
FIG. 3 shows a perspective rear view of niche of FIG. 1.
Figure 4:
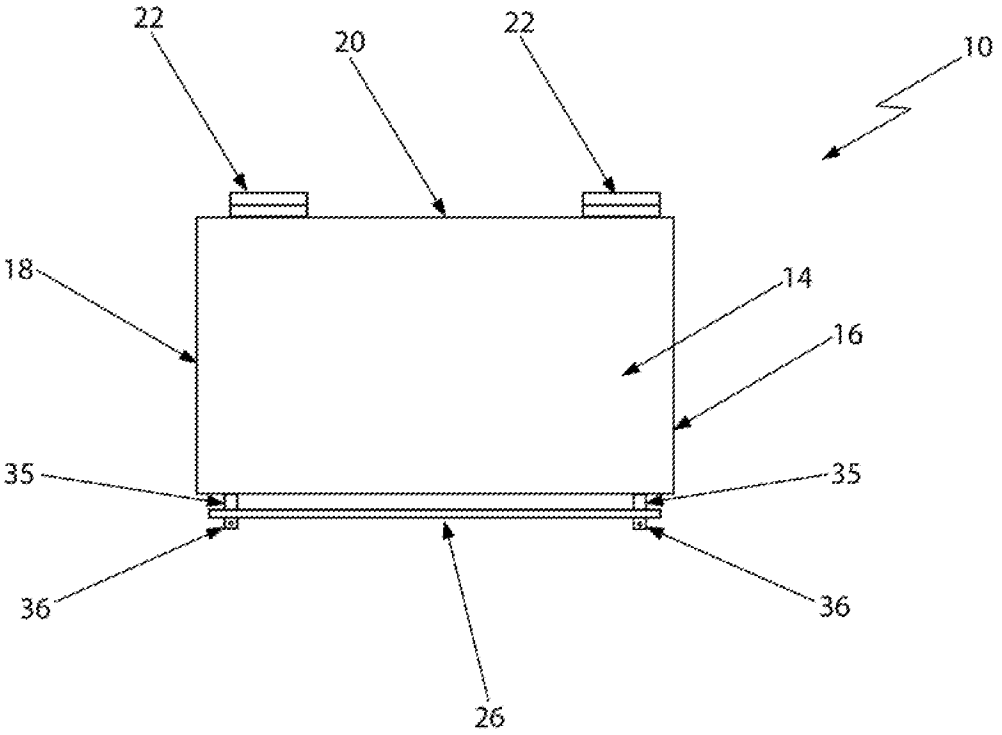
FIG. 4 shows a top plan view of niche of FIG. 1, the bottom plan view being substantially the same.
Figure 5:
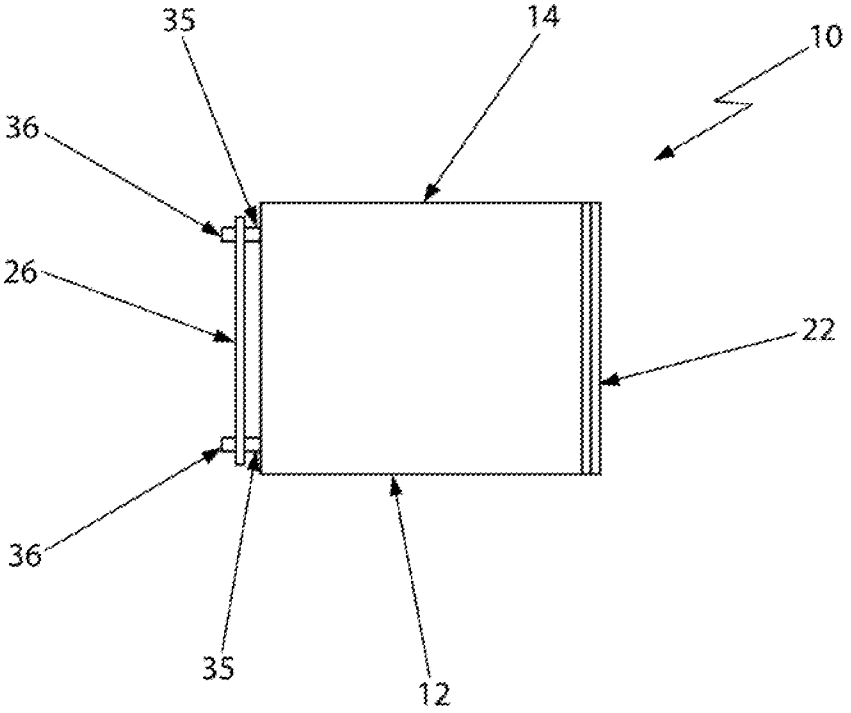
FIG. 5 shows a right side elevation view of niche of FIG. 1, the view in left side elevation being substantially the same.
Figure 7:
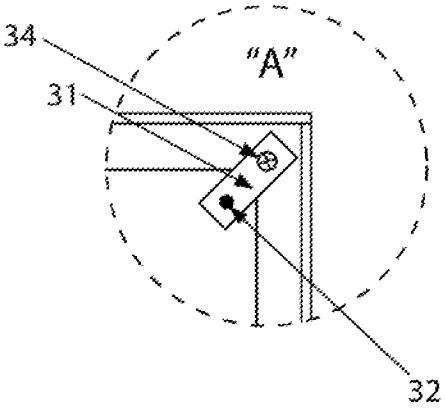
FIG. 7 shows a detailed view of section "A" of FIG. 6.
Figure 6:
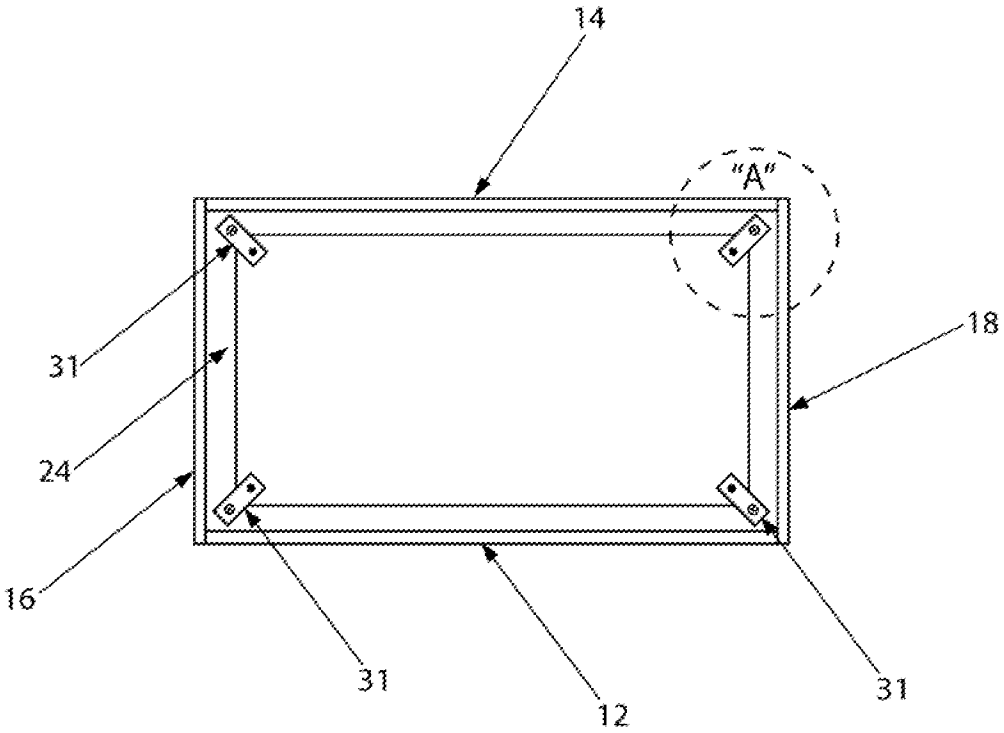
FIG. 6 shows a rear elevation view of niche of FIG. 1, where for purposes of assessing the interior of the niche a back wall has been removed that forms an integral part of the niche.
Figure 8:
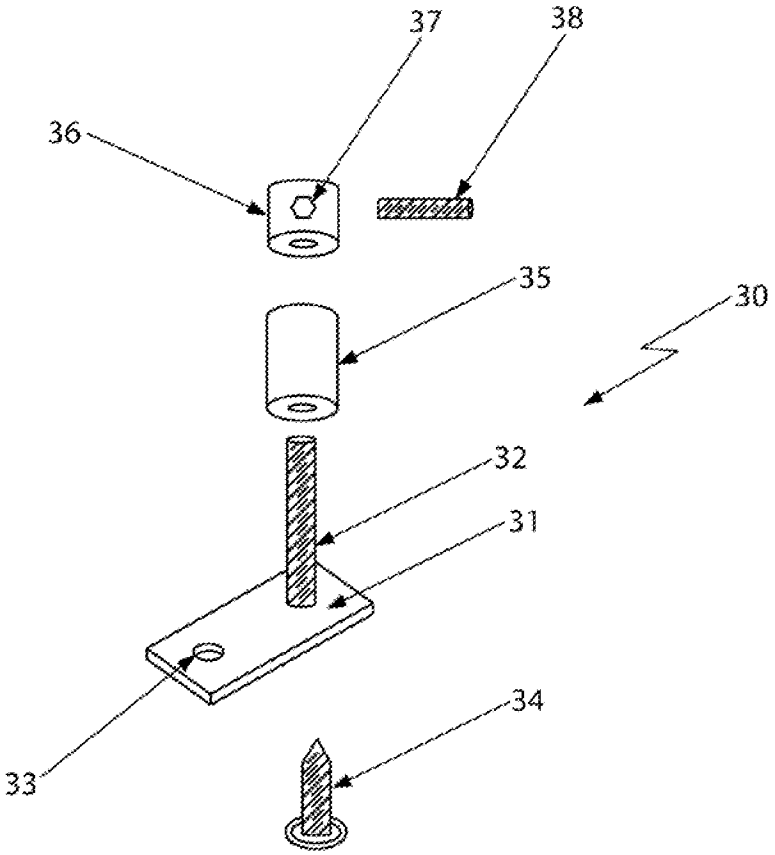
FIG. 8 shows an exploded view of a fastening and locking device forming an integral part of niche of FIG. 1.
Figure 10:
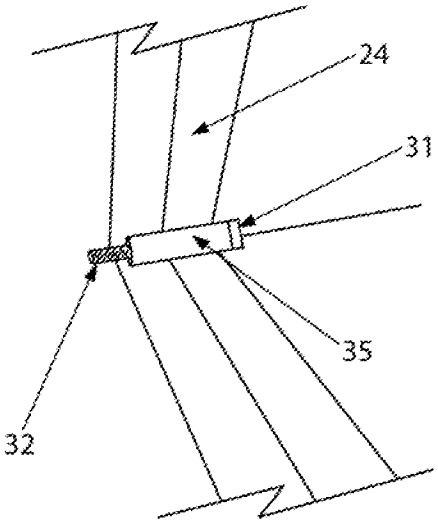
FIG. 10 shows a conventional perspective view of a section of niche of FIG. 1, where the arrangement of the device of FIG. 8 is seen when a spacer bushing forming an integral part of said device is arranged on it.
Figure 9:
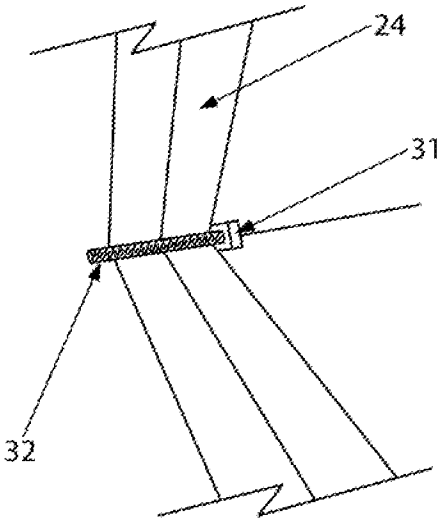
FIG. 9 shows a conventional perspective view of a section of niche of FIG. 1, where the arrangement of the device of FIG. 8 is seen.

The following description is provided to disclose the novel and relevant aspects, as well as various embodiments of illuminated niches for storing cinerary urns. Those skilled in the art will be able to appreciate additional embodiments and/or variants of the present invention that extend beyond to what is described herein. The terms included by any claim should be construed as defined in this description. The singular forms must be read to contemplate and describe plural alternatives. Similarly, plural forms must be read to contemplate and describe singular alternatives. Conjunctions should be read as inclusive except otherwise indicated.

Expressions such as "at least one or one" must be read to allow the inclusion of an element in a unique way or in combination with others of the same characteristics. All numbers, measurements and values are provided as approximations unless otherwise indicated.

Next, various aspects of the present invention will be described in detail, without limitation. In the following description, the integration of various components and their particular characteristics will be described, so that, from said integration, illuminated niches are defined for storing cinerary urns.

Those skilled in the art will appreciate that the term "niche" refers to a space or cavity formed to house something within, in case of the present invention, that something should be understood as urns containing human ashes or objects representing offerings to the dead.

It is not the intention of this description to make any additional claim about the way in which each of the elements that make up the illuminated niches for the store of cinerary urns operate individually, rather, this description focus on the structural configuration of illuminated niches for storing cinerary urns, which is the result of the systematic and operationally functional integration of various elements or devices that as a whole define in a novel and unique illuminated niches for storing cinerary urns in the terms and conditions presented to then, with the advantages stated in the objectives section of the invention previously presented.

With reference to what is shown in FIGS. 1 to 10, the composition of each of the illuminated niches for storing cinerary urns will now be discussed.

The illuminated niche for storing cinerary urns 10, hereinafter referred to as the niche 10, comprises a bottom wall 12, a top wall 14, a right side wall 16 and a left side wall 18, walls that together define a rectangular hollow body, wherein a rear wall 20 made of a translucent material is joined at one of its ends to the bottom walls 12, top wall 14, right side wall 16 and left side wall 18 allows to seal the niche at its rear end, at the same time allowing passage to the interior of the niche 10 of a light flux from at least one LED-type lighting source 22, a condition with which the objective of keeping the interior of the niche 10 illuminated is achieved.

In a preferred embodiment of the present invention the translucent material with which the back wall 20 is made is acrylic opal.

Around the bottom 12, top 14, right side 16 and left side walls 18 at the opposite end where these walls are in contact with rear wall 20, a perimeter frame 24 has been defined that, on the one hand defines an access area inside the niche 10 and on the other hand a support frame for a fastening system that allows the attachment or removal of an access door 26 to the interior of the niche 10; wherein said door 26 is made of a transparent material, such as glass or acrylic, which allows it to fulfill the function of being a screen through which it is possible to see the illuminated interior of the niche 10. The access door 26 comprises next to each of its corners a hole 28 that in combination with the fastening system allows it to be fixed or removed from the niche 10.

Thus, with the above-described configuration of the niche 10, the objective of having a total view towards the inside of the niche 10 that is illuminated without the need to remove the access door 26 is fulfilled, limiting the withdrawal of the latter only for the cases where it is desired to introduce or remove objects from the niche 10, that gives to the presented invention the features of being a niche 10 that does not need to be disassembled in order to clearly see what is inside it, thereby reducing the risk that the door 26 suffers some damage or malfunction as a result of unnecessary movements in order to have visual access to the interior of the niche 10.

On the other hand, the aforementioned fastening system that allows the fastening and/or removal of the access door 26, is integrated from four fastening and securing devices 30. According to what is shown in detail in FIG. 8, each of said devices 30 arranged at the corners of the perimeter frame 24 is comprised of a rectangular base 31 having next to one of its ends a threaded pin 32 and a hole 33 at the opposite end, so that said hole 33 allows the insertion of a fastening element 34 that can be a wooden pin, by means of which the device 30 is attached from inside the perimeter frame 24, as illustrated in detail in FIGS. 6 and 7. Device 30 further comprises a cylindrical shaped spacer bushing 35 arranged on the threaded pin 32 and define a stop for the placement of the access door 26 (see FIGS. 9 and 10).

When by means of holes 28, the access door 26 is disposed over the threaded bolts 32, a cylindrical nut 36 is threaded onto each of the four threaded bolts 32 of the fastening and securing devices 30 (see FIG. 2) thereby securing the position and permanence of said door 26, each of the nuts 36 have a threaded bore 37 in which a safety lock 38 is inserted which prevents the removal of said nuts 36 accidentally.

Figure 11:
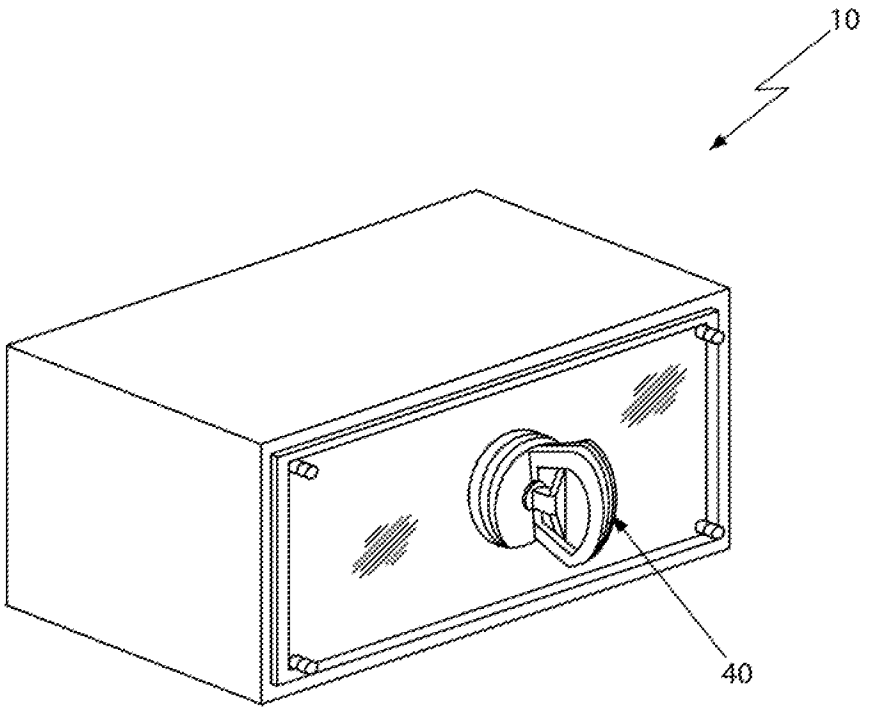
FIG. 11 shows a conventional perspective view of the niche of FIG. 1, where the provision of a manual suction cup helps to remove and/or place a cover element that forms an integral part of the niche is illustrated.

In order to maximize the security and care of access door 26 during the attachment and/or removal operations thereof, bearing in mind the material from which it is made, glass for example, it is delicate in its handling and may even represent a risk during an eventual improper removal of the said door 26, it has been deemed necessary to use a manual suction cup 40 which helps to remove and/or securely place the door 26 that forms an integral part of the niche 10 (see FIG. 11).

Figure 12:
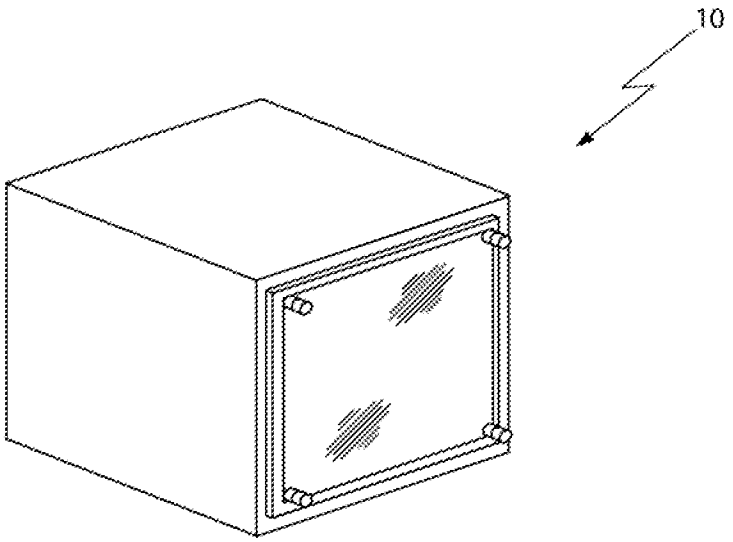
FIG. 12 shows a conventional perspective view of an embodiment of an illuminated niche for storing cinerary urns made in accordance with the present invention.
Figure 13:
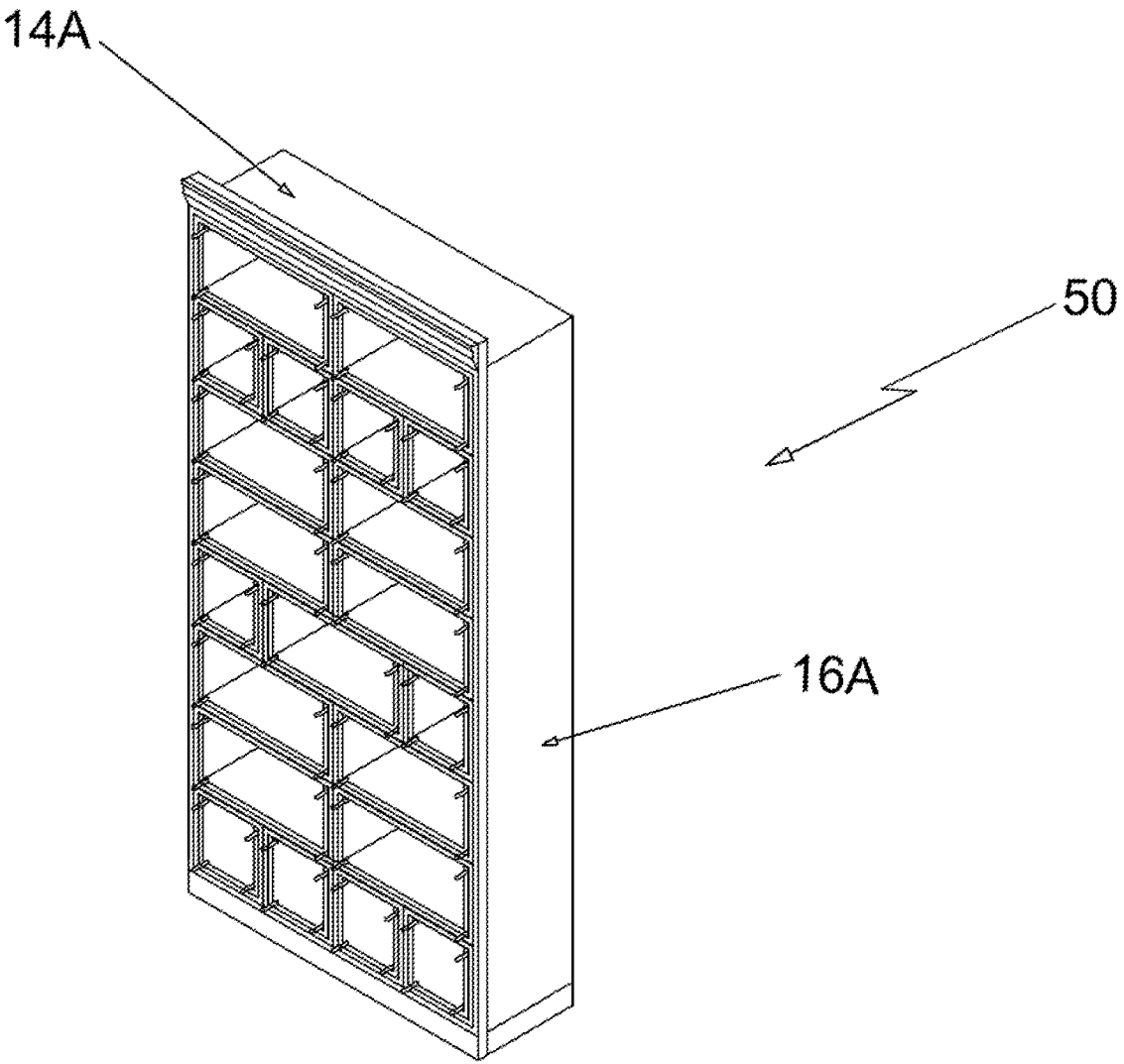
FIG. 13 shows a conventional perspective view of a columbarium that is built from a plurality of illuminated niches for storing cinerary urns, made in accordance with the present invention.
Figure 14:
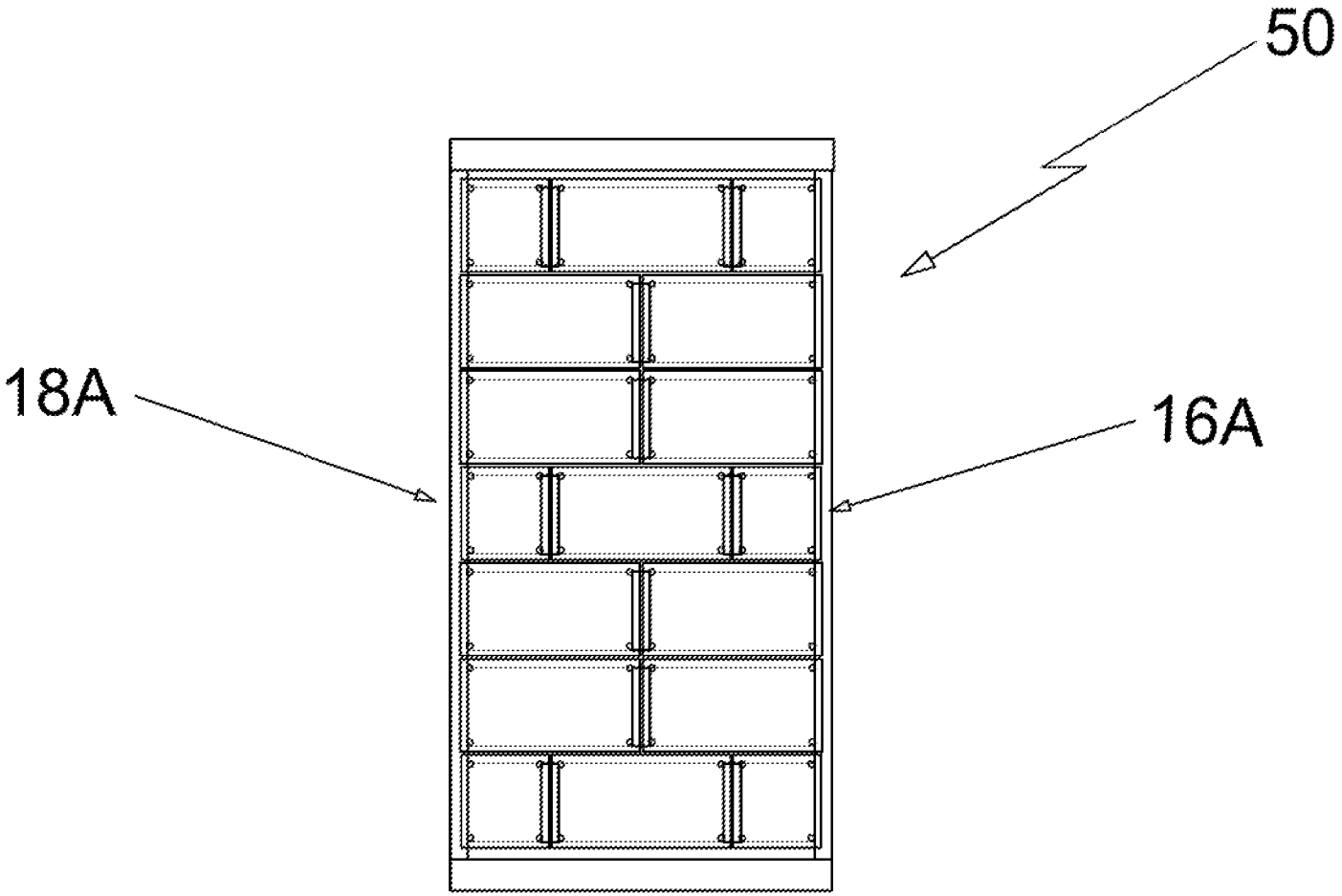
FIG. 14 shows a front elevational view of the columbarium of FIG. 13.
Figure 16:
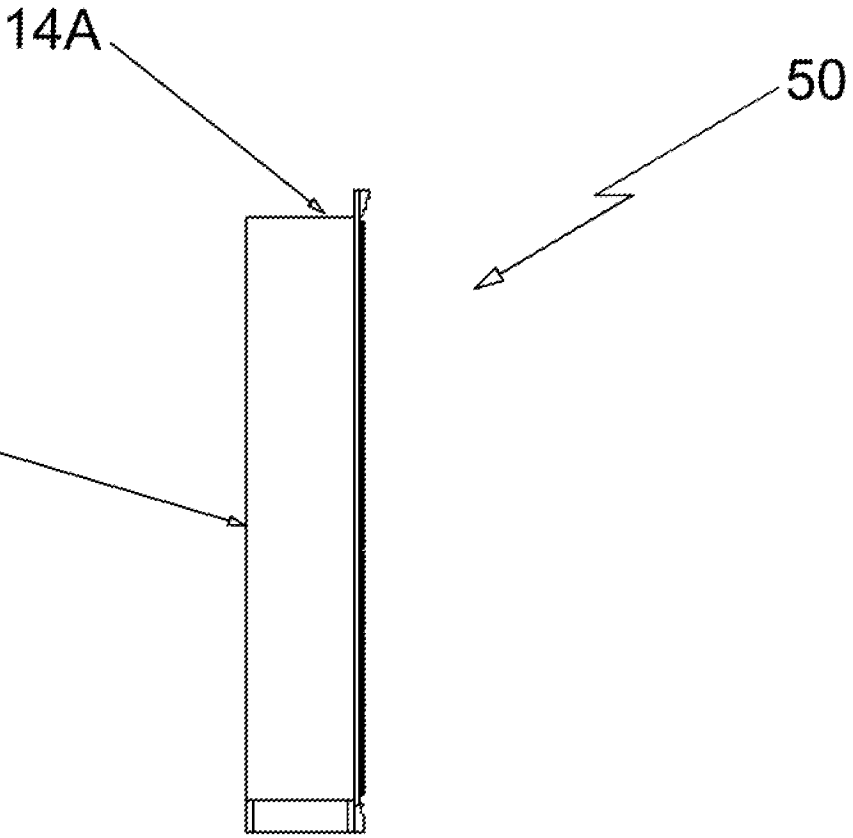
FIG. 16 shows a left side elevation view of the columbarium of FIG. 13
Figure 15:
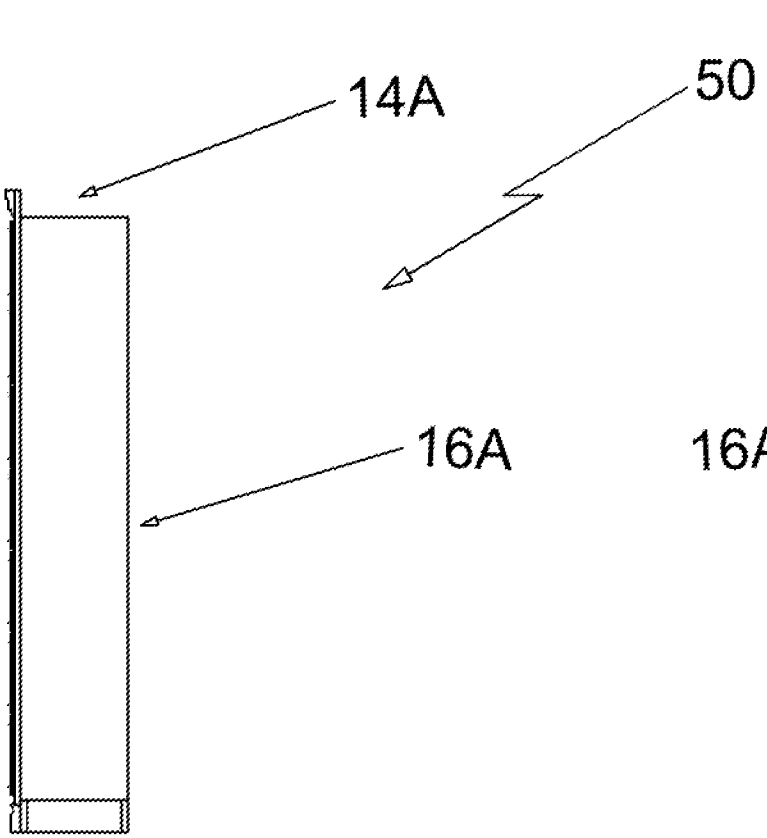
FIG. 15 shows a right side elevation view of the columbarium of FIG. 13.

FIG. 12 shows an embodiment of an illuminated niche for storing cinerary urns, made in accordance with the present invention, wherein, preferably but not limiting the bottom walls 12, top 14, right side 16 and left side 18 walls have the same dimension in their width, thus defining a quadrangular niche.

On the other hand, as shown in FIGS. 13 to 17, the integration of a plurality of niches 10 as described above and illustrated, can form a columbarium 50 that adapts in number of niches and dimensions to various spaces designed for its installation.

When several niches 10 are grouped together to integrate a columbarium 50, the top 14A, right side 16A, left side 18A and bottom walls (not shown) of the modular structure that together define the grouped niches 10, act as common walls for the plurality of niches 10, specifically, for those niches 10 that are arranged on the periphery of the modular arrangement, so that, with said arrangement, it is not necessary that each niche 10 be integrated with independent walls, because in any case the intervention of intermediate walls or shelves is only necessary to define the independent space of each niche 10.

Figure 17:
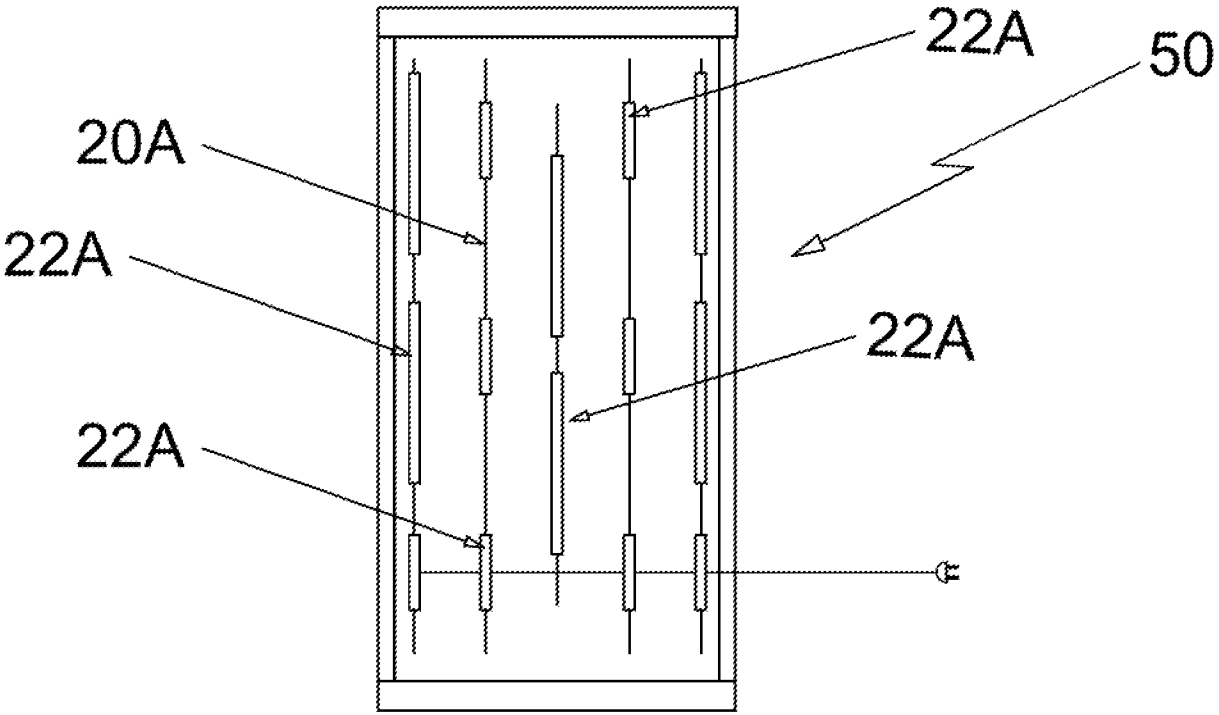
FIG. 17 shows a rear elevation view of the columbarium of FIG. 13.

In accordance with what is illustrated in FIG. 17, it is possible to appreciate that all the niches 10 that make up a modular or columbarium arrangement 50 share a same rear wall 20A, which as in the case of the rear wall 28 of each niche 10 individually, is made of a translucent material that allows the passage into the interior of each niche 10 of a luminous flux from at least one source of lighting 22A warm LED type.

It should also be said that in a columbarium 50 it is not necessary that each niche 10 be accompanied by light sources, for the specific case, in a columbarium 50, the lighting sources 22A can be arranged on the rear wall 20A, in such a way that with said arrangement it is possible to illuminate the interior of several niches 10 at the same time, that is, the illumination coming from said lighting sources 22A can be exploited by different niches 10 at the same time.

Both in the embodiment of individual structures and in the modular structures of niches 10, the sources of warm LED lighting (22 and 22A) that accompany them can be controlled through a traditional switch (not illustrated) that allows the passage or blockage of electrical energy or with the triggering of motion sensors (not shown) that sense the user motion and with it provide illumination for one or more niches 10 described above.

Although a plurality of niches 10 can integrate a columbarium 50, in which adjacent niches can share both a same left and right side, top, bottom or rear wall, it should be noted that each niche 10 will have individually an access door 26 and the ability to see through the door the illuminated interior of each niche 10, as described above.

Other embodiments not illustrated, but within the objectives of the present invention, should be understood as part of the illuminated niches for storing cinerary urns 10, such as the inclusion of colors, letters, numbers, figures, signs or textures in each one of the elements that make up the niches 10, the columbarium 50 or the environment where is mounted and that helps its best performance.

Although various aspects of illuminated niches for storing cinerary urns 10 have been described, said description is presented for the purpose of illustrating and not limiting the scope of the invention. The proposed niches are defined by the scope of the appended claims and not by the illustrations and examples provided in the above description. Those skilled in the art will appreciate further aspects of the invention, which may be implemented in alternative embodiments, after having the benefit of the above description. Other aspects, advantages, modalities and modifications are within the scope of the following claims.

The invention claimed is:

1. An illuminated niche for storing cinerary urns comprising:

a bottom wall, a top wall, a right side wall, and a left side wall, wherein said walls define a hollow rectangular body;

a rear wall made of a translucent material attached at one end to the bottom, top, right side, and left side walls so as to seal a rear end of the niche, wherein the rear wall allows the passage of a luminous flux coming from at least one source of light; and a perimeter frame provided around the bottom, top, right side, and left side walls at the opposite end where these walls are in contact with the rear wall, wherein the perimeter frame defines an access area to the interior of the niche and provides a support frame for a fastening system, wherein the fastening system is integrated from four fastening and securing devices, each comprising:

a rectangular base;

a threaded bolt located at one end of the rectangular base;

a hole located at an opposite end of the rectangular base, wherein the hole allows for the insertion of a locking member, by means of which the device is attached from inside the perimeter frame;

wherein the fastening system allows for the attachment or removal of an access door to the interior of the niche, wherein the access door is made of a transparent material configured to allow the access door to act as a screen through which it is possible to see the illuminated interior of the niche, wherein the access door defines a hole located next to each corner of the access door, wherein each hole, in combination with the fastening system, allows the access door to attach or remove from the niche.

2. The illuminated niche for storing cinerary urns as claimed in claim 1, wherein each of the four fastening and securing devices further comprise:

a cylindrical shaped spacer bushing arranged on the threaded bolt, wherein the cylindrical shaped spacer bushing defines a stop for the placement of the access door; and a cylindrical nut configured to be screwed on each of the threaded bolts so as to fasten the access door to the perimeter frame.

3. The illuminated niche for storing cinerary urns as claimed in claim 2, characterized in that each of the cylindrical nuts defines a threaded hole in which a safety prisoner is inserted so as to prevent accidental removal of the cylindrical nuts.

4. The illuminated niche for storing cinerary urns as claimed in claim 1, characterized in that the source of illumination is a warm light-emitting diode (LED).

5. The illuminated niche for storing cinerary urns as claimed in claim 4, characterized in that the lighting source is controllable via a switch or motion sensors.

6. The illuminated niche for storing cinerary urns as claimed in claim 1, characterized in that the translucent material from which the rear wall is made is opal acrylic.

7. The illuminated niche for storing cinerary urns as claimed in claim 1, characterized in that the material from which the access door is made is glass or acrylic.

8. The illuminated niche for storing cinerary urns as claimed in claim 1, further comprising a manual suction cup configured to allow attachment or removal of the access door.

9. The illuminated niche for storing cinerary urns as claimed in claim 1, characterized in that the niche is rectangular or quadrangular in shape.

10. A columbarium formed by grouping a plurality of niches as claimed in claim 1, characterized in that the grouping of niches are formed as a modular structure.

11. The columbarium of claim 10, characterized in that each niche in the columbarium share the same rear wall, wherein the shared rear wall is made of a translucent material, and wherein LED type lighting sources are arranged on the shared rear wall so as to illuminate the interior of two or more niches simultaneously.

12. The columbarium of claim 11, characterized in that the LED type lighting sources are controllable via a switch or motion sensors.

13. The columbarium of claim 10, characterized in that each of the niches forming the columbarium comprises an access door configured to act as a screen through which it is possible to see the illuminated interior of each niche.

14. The columbarium of claim 10, wherein each niche is removable from the modular structure so as to adapt the size of the columbarium based upon installation location.

* * * * *